US006338546B1

(12) United States Patent
Kotaki et al.

(10) Patent No.: US 6,338,546 B1
(45) Date of Patent: xwx.–99,–9999**

(54) INK JET HEAD CARTRIDGE AND INK JET APPARATUS HAVING SAME

(75) Inventors: Yasuo Kotaki; Kouji Yamakawa, both of Yokohama; Keiichiro Tsukuda, Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/353,615

(22) Filed: Jul. 15, 1999

Related U.S. Application Data

(62) Division of application No. 08/137,996, filed on Oct. 19, 1993, now Pat. No. 5,988,804.

(30) Foreign Application Priority Data

Oct. 20, 1992 (JP) ..... 4-281866
Jan. 19, 1993 (JP) ..... 5-006985

(51) Int. Cl.[7] ..... B41J 2/175
(52) U.S. Cl. ..... 347/49; 347/87
(58) Field of Search ..... 347/49, 85, 86, 347/87, 22, 29, 31; 53/79, 403

(56) References Cited

U.S. PATENT DOCUMENTS

| | | | | |
|---|---|---|---|---|
| 4,771,295 A | | 9/1988 | Baker et al. | |
| 4,872,026 A | | 10/1989 | Rasmussen et al. | |
| 5,025,727 A | | 6/1991 | Barbour | |
| 5,119,115 A | | 6/1992 | Buat et al. | |
| 5,138,344 A | | 8/1992 | Ujita | |
| 5,155,502 A | | 10/1992 | Kimura et al. | |
| 5,162,817 A | | 11/1992 | Tajika et al. | |
| 5,212,502 A | | 5/1993 | Bowling | |
| 5,231,416 A | * | 7/1993 | Terasawa et al. | 347/23 |
| 5,365,260 A | | 11/1994 | Kitani et al. | |
| 5,988,804 A | * | 11/1999 | Kotaki et al. | 347/49 |

FOREIGN PATENT DOCUMENTS

| | | | |
|---|---|---|---|
| EP | 418828 | | 3/1991 |
| EP | 469536 | | 2/1992 |
| EP | 519457 | | 12/1992 |
| JP | 54-151033 | | 11/1979 |
| JP | 57-176546 | | 11/1982 |
| JP | 1-141750 | | 6/1989 |
| JP | 2-39945 | | 2/1990 |
| JP | 4-7157 | * | 1/1992 |
| JP | 5-162299 | | 6/1993 |

* cited by examiner

*Primary Examiner*—Judy Nguyen
(74) *Attorney, Agent, or Firm*—Fitzpatrick, Cella, Harper & Scinto

(57) ABSTRACT

An ink jet head cartridge having a recording head without an ink container includes a casing with an ink ejection device; and a structural member on the casing for improving handling of the recording head.

3 Claims, 5 Drawing Sheets

INK JET HEAD CARTRIDGE AND INK JET APPARATUS HAVING SAME

This application is a division of application Ser. No. 08/137,996, filed Oct. 19, 1993, now U.S. Pat. No. 5,988, 804.

FIELD OF THE INVENTION AND RELATED ART

The present invention relates to an exchangeable ink jet head cartridge and an ink jet apparatus usable with the exchangeable head cartridge, and in particular an ink jet head cartridge capable of enhancing handleability during the transportation or installation into the ink jet apparatuses, and an ink jet apparatus usable with such an ink jet head cartridge.

Recently, printers incorporating a so-called ink Jet recording system, in which ink is ejected from a recording head In response to recording signals to produce a desired print, have been put into practical use, along with office automation apparatuses comprising such a printer.

The recording head employed in the printer incorporating such an ink jet recording system can be roughly classified into a so-called permanent type recording head which is permanently mounted in the apparatus, and a so-called exchangeable type recording head which can be easily installed into, or removed from, the apparatus by an operator.

The recording head of the former type is permanently installed in the apparatus, as was proposed in Japanese Laid-Open Patent Application No. 151,033/1979 or Japanese Laid-Open Utility Model Application No. 176,546/1982. The ink is supplied to the recording head by connecting the recording head to an ink container, with a tube. The ink container used in the apparatus having such a structure is of a cartridge type, which can be easily mounted in, or removed from, the apparatus.

The recording apparatus usable with the recording head of such a type can have an extremely long service life since its service life can be extended by exchanging the ink container cartridge. However, in this type of recording apparatus, the recording head and the ink cartridge are connected with a tube, which requires a space through which the tube is routed, or a space into which the ink cartridge is fitted; therefore, the apparatus size tends to become relatively large.

On the other hand, the recording head of the latter type is a combination cartridge, in which the ink container and the recording head are integrally formed, and can be easily mounted in, or removed from, the apparatus. The cartridge is exchanged with a new one when the amount of the ink in the cartridge in use comes down to a level where further consumption of the ink is impossible. This type of recording head cartridge Is easily reduced in size and cost; therefore, it is preferable for personal use.

Recently, subjects such as efficient use of natural resources or waste disposal have been attracting international attention.

In the aforementioned ink container-ink jet head combination cartridge, the elements for ejecting the ink were sufficiently durable relative to the amount of the ink containable in the ink container. In other words, the recording head portion was still in good shape even when the ink in the cartridge was exhausted. Therefore, improvement of the cartridge was considered.

For example, in Japanese Laid-Open Patent Application No. 39945/1990, a recording head-ink container combination cartridge is disclosed which allows the separation of the recording head portion from the ink container portion as needed. In the case of this cartridge, when the ink in the ink container portion is exhausted while a sufficient amount of service life is left in the recording head portion, only the ink container portion need be exchanged: when the service life of the recording head portion ends, only the recording head portion need be exchanged if the ink is still in the ink container portion, and both can be exchanged if the ink happens to be out at the same time.

The recording head portion and the ink container portion in the recording head-ink container combination cartridge having such a structure are extremely small, in consideration of the cartridge size; therefore, when they are separated from each other, their extremely small sizes reduce handling efficiency when they are installed into, or removed from, the apparatus, or when a new recording head portion or new ink container portion is taken out of a shipment package.

The recording head portion comprises electrodes, which constitute portions of the transmission passages for recording signals. When these electrodes are mistakenly touched, unexpected problems may arise.

Further, when the separable recording head portion and the separable ink container portion are stored in the same shipment container during the merchandise distribution, the evaporative components of the ink in the ink container changes the ambience within the shipment container into a highly humid one, which adversely affects the electrodes of the recording head portion, or the flexible cable, deteriorating the recording head performance.

In addition, when the recording head portion and the ink container portion are designed to be separable, the size of each portion becomes rather small, and having the small size reduces the handleability of each portion during the manufacturing, or tends to trigger unintentional operator mistakes such as touching the electrodes of the recording head portion.

SUMMARY OF THE INVENTION

Accordingly, the present invention was made to eliminate such problems. Hence, the primary object of the present invention is to provide an ink jet head cartridge comprising a recording head portion and an ink container portion which offer better handleability while being separated from each other, and the critical areas of which, such as the electrodes or ejection orifices, are well protected from unintentional touching by a handler, improving the reliability, and to provide an ink jet apparatus comprising such a cartridge.

The inventors of the present invention came to realize after the intensive studies for solving the above described problems, that packaging separately the recording head portion and the ink container portion, and the provision of a dedicated structure for improving the handleability of the recording head portion and the ink container portion, would improve the handleability of the recording head portion and the ink container portion, and also, would guarantee their reliability.

The present invention has been made based on the above finding, and is embodied as an ink jet head cartridge comprising a recording bead portion and an ink container portion which are separable from each other; are separately shipped; and are integrated with each other as they are mounted in an recording apparatus, for a printing operation, wherein said recording head portion is provided with a structural member for improving the handleability of said recording head portion when said recording head portion and ink container portion are separately shipped and transported (before use for recording).

Also, the present invention is embodied as an ink jet apparatus comprising a carriage member for mounting an ink jet head cartridge comprising a recording head portion and an ink container portion which are separable from each other; are separately shipped; and are integrated with each other as they are mounted in a recording apparatus for a printing operation, wherein said carriage comprises an operational member for mounting or removing said recording head portion, and said operational member is provided with an area for pressing down, from above, a tag-like structural member provided on said recording head portion for improving the handleability.

Further, according to an aspect of the present invention, the recording head portion is provided with a structural member dedicated to improving the handleability, wherein handling the recording head portion by this dedicated structural member can prevent the electrode portion or the ejection orifice portion from being mistakenly touched.

According to another aspect of the present invention, the orientation of the recording head portion becomes consistent, which affords more reliable handling of the recording head portion.

According to a further aspect of the present invention, the evaporative ink components, which deteriorate the reliability of the recording head portion, are rarely allowed to evaporate during transportation.

DETAILED DESCRIPTION OF EMBODIMENTS

Hereinafter, embodiments of the ink jet head cartridge in accordance with the present invention and the ink jet apparatus usable with such an ink jet head cartridge will be described, referring to drawings.

Figure 1:
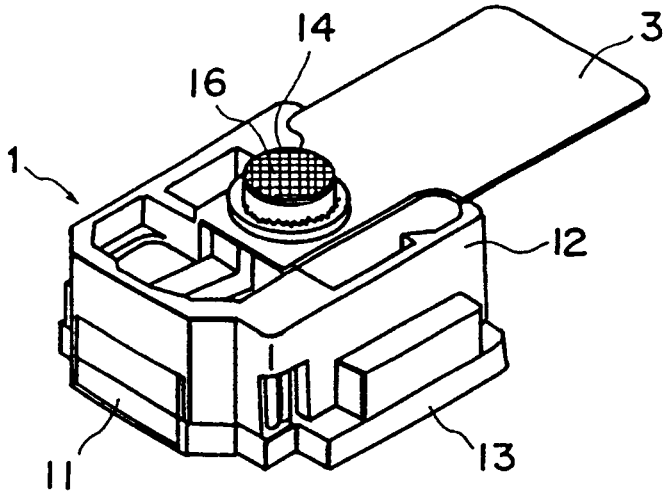
FIG. 1 is an oblique view of a recording head portion provided with an embodiment of the structural member in accordance with the present invention.

FIG. 1 is an oblique view of the recording head portion of the recording head-ink container combination cartridge in which the recording head portion and the ink container portion are separable from each other.

A recording head portion 1 comprises an ink ejecting portion 11 provided with ejection orifices for ejecting ink, a main head assembly 12, and an aluminum plate 13 on which the preceding two components are supported. The main head assembly 12 is provided with a connector pipe 14 which is coupled with an ink container 2 to receive the ink. The connector pipe 14 has a filter 16 covering the opening, that is, the interface between the connector pipe 14 and the ink container 2.

This recording head portion has a tag 3, which is a structural member dedicated for improving the handleability of the recording head portion, and is attached to the recording head portion 1 with use of connector pipe 14. The tag 3 extends in the direction opposite to the ink ejecting portion 11 side, long enough to be firmly grasped by an operator, but not long enough to stick out of the carriage when mounted in the carriage. Provision of this type of tag 3 on the side opposite to the ink ejecting portion 11 can prevent the operator from unintentionally touching the ink ejecting portion 11, preventing thereby unfortunate accidents such as damaging the ejection surface. Further, this recording head portion has an electrode pad 15, which is located on the top surface of the aluminum plate 13 for receiving recording signals from the recording apparatus, and is connected to the recording head portion with use of a flexible base plate. Here, since the operator can handle the recording head portion by grasping the tag 3, he is prevented from unintentionally touching the electrode pad 15.

Further, in this embodiment of the ink jet recording apparatus according to the present invention, the ink is ejected downward during recording. When the recording head portion 1 is mounted in the carriage of the recording apparatus, it is lowered from above, the steps for which will be described later; therefore, it is preferable for the tag 3 to be located on the side opposite to the ink ejecting portion 11. Needless to say, in recording apparatuses having different structures, the tag 3 may be moved, as needed, to a more convenient location In each of the respective apparatuses, as long as the electrode pad 15 and the ink ejecting portion 11 are prevented from being unintentionally touched by the operator.

Figure 2:
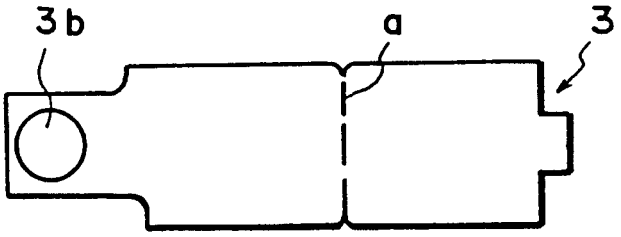
FIG. 2(*a*) is a development of the embodiment of the structural member according to the present Invention, and FIG. 2(*b*) is a plan view of the finished member.
Figure 2:
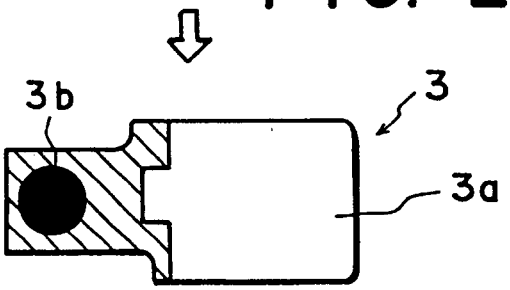

FIG. 2(*a*) is a development of the tag 3, and FIG. 2(*b*) is a plan view of the tag 3. As shown in the drawings, the tag 3, which is foldable at a folding line indicated by a broken line a in FIG. 2(*a*), comprises a portion 3*a* (which is a tab portion) which is folded as shown in FIG. 2(*b*), and a portion 3*b* (which is a portion coated with adhesive and is glued on the side surface of the recording head portion's main assembly), through which the connector pipe 14 of the recording head portion 1 is inserted, without being covered by the folded portion 3*a*. The above described structure of the tag 3 affords sufficient rigidity to the tab portion 3*a*, and allows the tag to be adhered to the side surface of the recording head portion 1 by the adhering portion 3*b*.

Figure 3:
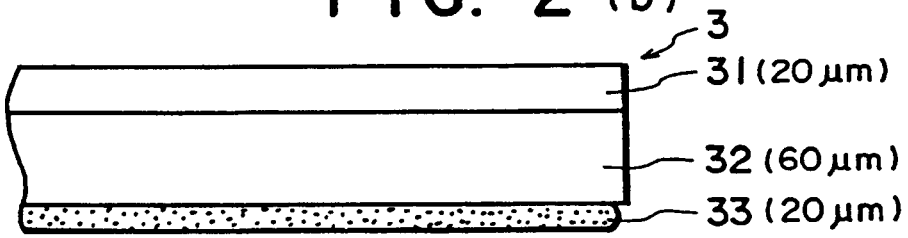
FIG. 3 is a sectional view of the structural member according to the present invention, depicting its lamination.

The tag 3 comprises two layers of stretched polypropylene of different types (hereinafter, OPP) as shown in FIG. 3, wherein a 20 μm thick first OPP layer 31 and a 60 μm thick second OFF layer 32 are pasted with an extremely thin layer of adhesive (unshown). The outward facing surface of the second OFF layer 32 is coated with a 20 μm thick layer of adhesive 33. This adhesive layer 33 plays two adhesive roles; it adheres the folded portion of the tag 3 to form the tab portion 3*a* when the tag 3 is folded with the adhesive side facing inward, and also, adheres the tab 3 to the recording head portion 1. This structural arrangement simplifies the manufacturing steps, reducing thereby the cost.

The reason why OPP is used as the material for this embodiment of the tag 3 is that OPP has relatively high rigidity and excellent resiliency; can be easily wiped clean when soiled by the ink; possesses excellent resistance to ammonia gas; and also, is excellent in processability.

According to the tests conducted by the inventors, OPP was selected as the most suitable material for the tag 3 because of the aforementioned reason. However, the material for the tag 3 is not limited to OPP; synthetic paper, nylon, polyester, or the like, or combinations of the preceding materials, may be chosen as needed.

The recording head portion is packaged separately from the ink container portion during transportation because of a concern that the recording head portion is affected by the evaporative components of the ink in the ink container portion. In this case, the aforementioned tag 3 alone is not enough to improve the handleability of the extremely small recording head portion. Further, the recording head portion comprises exothermic elements for ejecting the ink, and in order to prevent these exothermic elements from being deteriorated by oxidation or the like, it is preferable to keep the recording head portion filled with the same ink as will be used for recording, or with ink solvent, that is, the ink minus the coloring agent. Now that the recording head portion is filled with the ink or ink solvent, an additional structure is required to prevent the ink filled in the recording head from leaking during the transportation. If this structure is made to double as the structural member for improving the handleability, the handleability of the recording head portion 1 is further improved.

Figure 4:
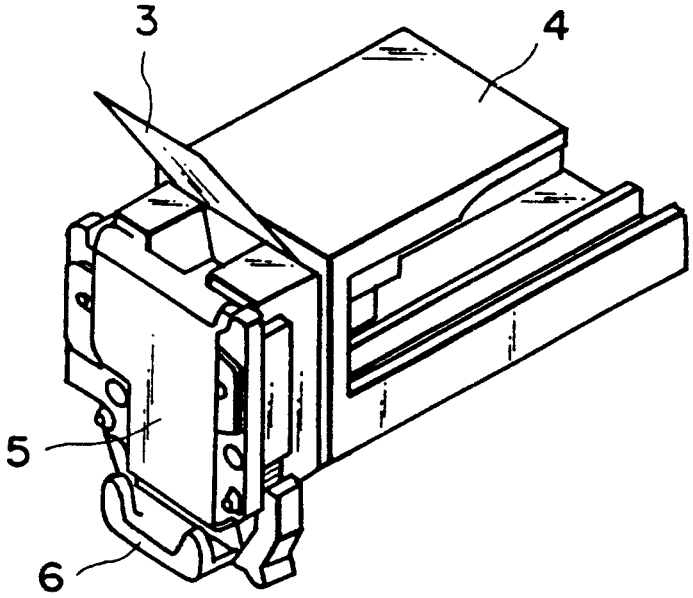
FIG. 4 is an oblique view of a recording head portion provided with an alternative embodiment of the structural member according to the present invention.

FIG. 4 is an oblique view of the recording head portion 1 provided with the structural member for improving the handleability during transportation. This structural member is a handling member 4, looking like the ink container portion, and is attached to the recording head portion 1 in substantially the same manner as the ink container portion 2. The recording head portion shown in FIG. 4 is provided with a sealing member 5 for preventing the ink from leaking out of the ejection orifices 11, and also preventing the electrode pad from being directly touched by a finger or the like, and a capping member 6 for holding down, during transportation, the sealing member 5 which covers the ejection orifices 11.

Figure 5:
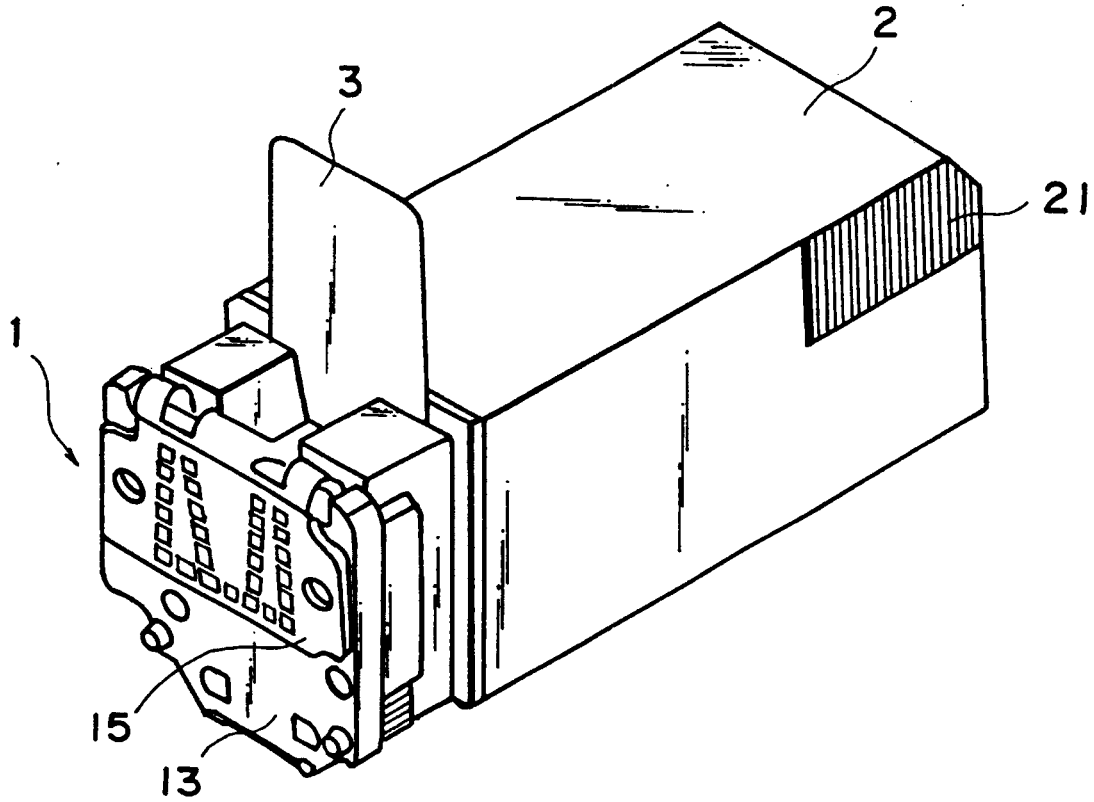
FIG. 5 is an oblique view of the recording head portion provided with the structural member according to the present invention, being coupled with an ink container portion.
Figure 6:
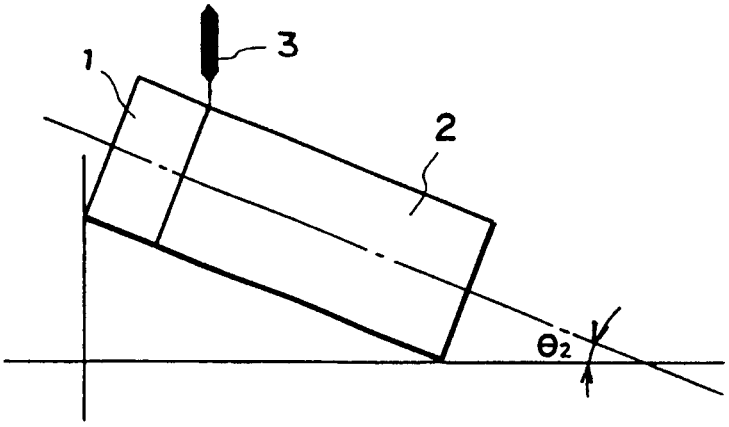
FIG. 6 is a schematic drawing depicting the balance of an embodiment of the ink jet head cartridge in which the recording head portion and the ink container portion have been integrated (coupled).
Figure 7:
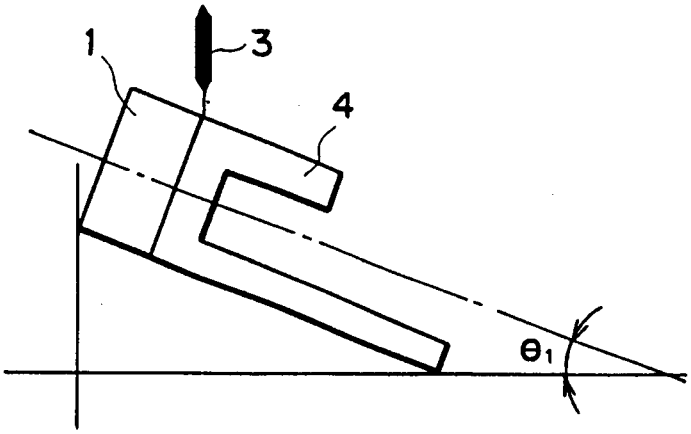
FIG. 7 is a schematic drawing, depicting the balance of the ink jet head cartridge in which the recording head portion has been integrated with an alternative embodiment of the structural member according to the present invention.

In addition, when the recording head portion 1 having the handling member 4 of this embodiment is picked up by the tag 3, the handling member 4 serves as a balancing member for affording substantially the same balance as when the cartridge shown in FIG. 5, in which the recording head portion 1 has been integrated with the ink container portion 2, is picked up by the tag 3. In other words, where θ2 is an angle at which the cartridge comprising the recording head portion 1 integrated with the ink container portion balances when picked up by the tag 3 as shown in FIG. 6, and θ1 is an angle at which the cartridge comprising the recording head portion 1 provided with the handling member 4 balances when picked up by the tag 3 as shown in FIG. 7, the substantial relation between θ1 and 92 is: θ1=θ2.

When the handling member 4 is designed to afford the balance as represented by the above equation, all that is needed to be done when the recording head portion must be mounted into the carriage is to take the recording head portion out of the package and simply lower it into the carriage from the handling member side, as will be described later.

Further, the handling member 4 is configured to allow the recording head portion 1 to be mounted in the carriage of the recording apparatus, with the handling member 4 being on the recording head, and is removed through the same process as that for removing the ink container portion from the recording head. More specifically, the configuration of the handling member 4 portion to be joined with the recording head portion 1 is substantially the same as that of the ink container portion 2. Since the configuration of the handling member 4 portion to be joined with the recording head portion 1 is substantially the same as that of the ink container portion 2, the handling member 4 can be removed through the same process as that for mounting or removing the ink container portion 2. Further, since the handling member 4 can be removed while the recording head is in the carriage, the ink in the recording head 1 is prevented from being carelessly leaked while handled, assuring thereby errorless removal of the handling member 4.

Further, the handling member 4 does not need to be configured like the substantial U shape as shown in FIG. 4. The configuration of the handling member 4 may be different as long as the configuration of the contact portion to be joined with the recording head portion 1 is the same as that of the contact portion of the ink container portion, and allows the recording head portion 1 to be perfectly fitted in the carriage or to be removed through the same process as that for removing the ink container portion. In this embodiment, a configuration in which the handling member 4 is extended longer on the side opposite to the tag 3 is adopted to accomplish the aforementioned balance.

Figure 8:
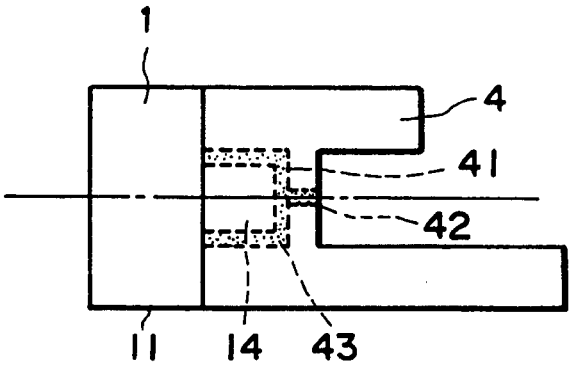
FIG. 8 is a schematic view of another alternative embodiment of the structural member according to the present invention.

Further, the handling member 4 has a recessed portion 41 into which the connector pipe 14 of the recording head portion 1 fits, as shown in FIG. 8, when the handling member 4 is attached to the recording head portion 1. As the connector pipe 14 fits into the recessed portion 41, a gap 43 is created between the connector pipe 14 and the recessed portion of the handling member. When the ambient conditions change, the ink may be forced to leak out of the ejection orifice 11 of the recording head portion, by the expansion of the air in this gap 43, or the ink may be forced to retreat from the exothermal element portion of the recording head portion 1, by the contraction of the same air, inviting thereby the oxidation of the exothermic elements. In other words, the air in this gap 43 is liable to affect adversely the recording head portion 1. Therefore, the recessed portion 43 is provided with a vent 42 which leads to the outside, so that the air in the gap 43 between the connector pipe 14 and the handling member 4 can be prevented from affecting adversely the recording head portion 1 by the volumetric changes of the air caused by the changes in the ambient conditions.

Figure 9:
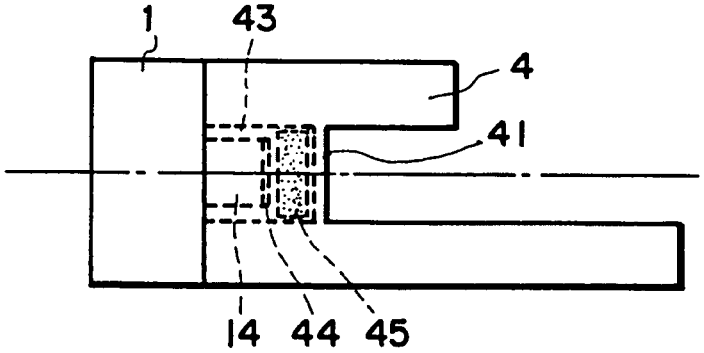
FIG. 9 is a schematic view of a further alternative embodiment of the structural member according to the present invention.

Further, the above described structure, shown in FIG. 8, is liable to allow foreign matter to enter through the vent 42, and when the foreign matter is allowed to enter, it is liable to adhere to the filter 16 provided on the connector pipe 14 of the recording head portion, which may affect the amount of the ink supplied from the ink container. In order to eliminate these liabilities, and also, to prevent the ink within the recording head from evaporating through the vent 42, a filter 44 or an absorbing member 45 soaked with recording ink, or both of them, may be provided in the gap 43 in the recessed portion 41, as shown in FIG. 9.

The recording head portion 1 is packaged after the handling member 4 is attached, in addition to the tag 3. The ink container portion 2 is separately packaged from the recording head portion.

Next, it will be briefly described how the recording head portion is handled when the packaged recording head portion is unpacked and mounted in the carriage.

Figure 10:
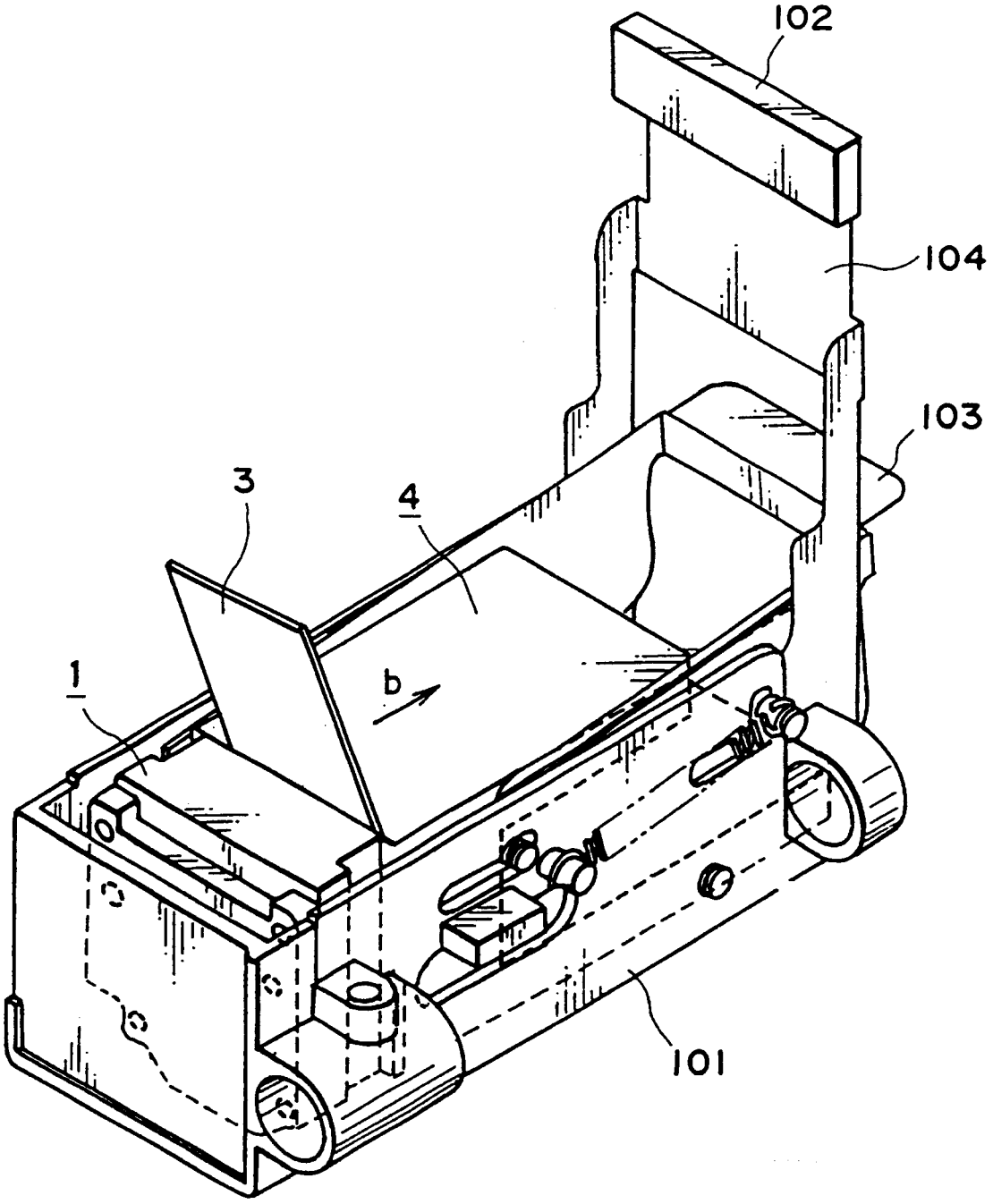
FIG. 10 is a schematic oblique view of a recording head portion and a carriage, depicting the initial stage of installing the former into the latter.
Figure 11:
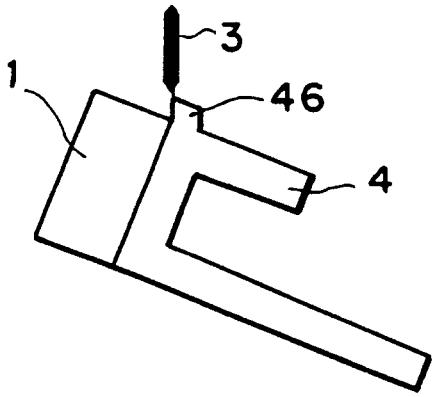
FIG. 11 is a schematic view of another alternative embodiment of the structural member according to the present invention.

First, the recording head portion 1 is taken out of the package. Next, the carriage 101 of the recording apparatus shown in FIG. 10 is prepared to accommodate the recording head portion 1 by pulling up a head exchange lever 102 of the carriage 101. Then, the recording head 1 is picked up by the tag 3 and is lowered into the carriage ready for accommodating the recording head portion 1. At this time, the recording head portion 1 is slanted at the angle 91, with the rear end of the handling member 4 hanging lower, as shown in FIG. 7; therefore, the recording head portion 1 comes to be lowered into the carriage from the handling member 4 side. Then, the recording head portion exchange lever 102 is pushed down, completing the process of mounting the recording head portion 1 into the carriage. The head exchange lever 102 has a flat area 104, which serves to fold down the tag 3 of the recording head portion 1 toward the recording head portion. In order to facilitate the folding of the tag 3, the handling member 4 may be provided with a projection 46 having a surface angled toward the recording head portion, as shown in FIG. 11. With presence of this projection 46, the tag 3 is slightly tilted toward the recording head when the recording head is inserted in the carriage 101; therefore, the tag 3 is surely folded down onto the recording head portion 1 by the flat area 104 as the head exchange lever 102 is pushed down.

Figure 12:
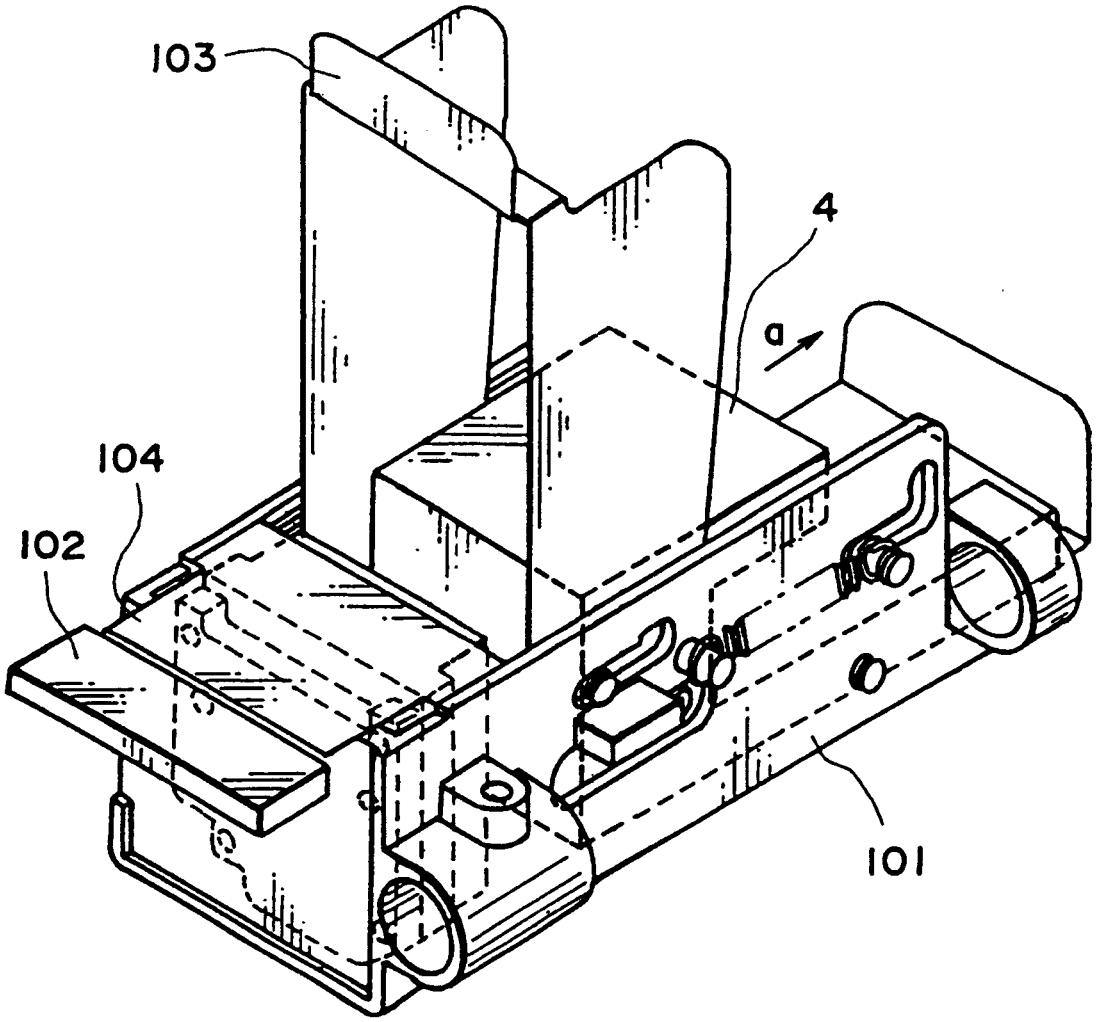
FIG. 12 is a schematic oblique view of the recording head portion and the carrier, depicting how the structural member of the recording head portion is removed.

Next, an ink container portion exchange lever 103 is pulled up as shown in FIG. 12, whereby the handling member 4 attached to the recording head portion 1 is pulled away from the recording head portion 1 in the direction indicated by an arrow a. Thus, the recording head portion 1 inserted in the carriage 101 is separated from the handling member 4.

The handling member 4 which has been pulled off the recording head portion 1 can be easily taken out of the carriage by the operator. As the handling member 4 is removed, the carriage 101 provides a space. The ink container 2 is lowered into this space, and the ink container portion exchange lever 103 is pushed down, which in turn integrates the ink container portion 2 with the recording head portion 1, readying the ink container portion to supply the ink.

The provision of a structural member dedicated to improve the handleability of the recording head portion makes it extremely easy to handle the recording head portion. Since the recording head portion is handled by the structural member dedicated to improve the handleability of the recording head portion, the electrode portion of the recording head portion is prevented from being touched, and also, the orientation of the recording head portion becomes consistent, promoting errorless handling of the recording head portion.

Further, the handling member is coupled with the connector pipe of the recording head by the recessed portion; therefore, the evaporative Ink components, which deteriorate the recording head portion reliability, are rarely allowed to evaporate during transportation.

Therefore, a recording apparatus comprising the recording head affording excellent handleability as described above is capable of producing a superior print.

While the invention has been described with reference to the structure disclosed therein, it is not confined to the details set forth and this application is intended to cover such modifications or changes as may come within the purposes of the improvements or the scope of the following claims.

What is claimed is:

1. An ink jet ejecting system comprising:

an ink jet recording head having an ink ejection portion and an ink supply member for supplying ink to said ink ejection on portion;

a protection member detachably connected to said ink supply member of said ink jet recording head to protect said ink supply member, for being removed upon start of use of said ink jet recording head; and an ink container detachably connectable in substitution for said protection member to said ink supply member of said ink jet recording head, said ink jet recording head and ink container comprising, in combination, an ink jet head cartridge, wherein said protection member has a recess for protecting said ink supply member, said recess being provided in a bottom side of said protection member with an air vent; and an ink absorbing member provided in the recess and containing recording ink or ink solvent without coloring material, wherein said air vent provides for fluid communication of said ink supply member with ambience through said ink absorbing member.

2. A protection member detachably mountable to an ink supply member of a liquid ejecting recording head to protect the ink supply member, the ink supply member for supplying liquid to the liquid ejecting recording head from an ink container containing liquid, the liquid container detachably mountable to the ink supply member in place of said protection member, the liquid ejecting recording head and the ink container comprising, in combination, an ink jet head cartridge, said protection member comprising:

a recess for protecting said ink supply member, said recess being provided in a bottom side of said protection member with an air vent; and an ink absorbing member provided in the recess and containing recording ink or ink solvent without coloring material, wherein said air vent provides for fluid communication of said ink supply member with ambience through said ink absorbing member when said ink supply member is mounted to said protection member.

3. A protection member according to claim 2, wherein a shape of said recess of said protection member is substantially the same as a shape of a mounting portion of the ink container.

* * * * *

UNITED STATES PATENT AND TRADEMARK OFFICE

CERTIFICATE OF CORRECTION

PATENT NO. : 6,338,546 B1
DATED : January 15, 2002
INVENTOR(S) : Yasuo Kotaki et al.

It is certified that error appears in the above-identified patent and that said Letters Patent is hereby corrected as shown below:

Title page,
Item [45], Date of Patent, "xwx.-99,-9999" should read -- Jan. 15, 2002** --.

Column 1,
Line 17, "Jet" should read -- jet --;
Line 19, "In" should read -- in --; and
Line 55, "Is" should read -- is --.

Column 3,
Line 38, "Invention," should read -- invention, --.

Column 6,
Line 7, "92" should read -- θ2 --.

Column 8,
Line 3, "Ink" should read -- ink --; and
Line 20, "on" should be deleted.

Signed and Sealed this

Twenty-seventh Day of August, 2002

*Attest:*

*Attesting Officer*

JAMES E. ROGAN
*Director of the United States Patent and Trademark Office*